United States Patent [19]

Swart et al.

[11] 4,432,862

[45] Feb. 21, 1984

[54] REFORMING AND ISOMERIZATION PROCESS

[75] Inventors: Gerrit S. Swart, Westfield; Louis S. Dauber, Cranford; Richard P. O'Connor, Basking Ridge, all of N.J.

[73] Assignee: Exxon Research and Engineering Co., Florham Park, N.J.

[21] Appl. No.: 340,071

[22] Filed: Jan. 18, 1982

[51] Int. Cl.[3] ..... C10G 35/04

[52] U.S. Cl. ..... 208/64; 208/65; 208/134; 585/738

[58] Field of Search ..... 208/64, 65, 134; 585/738

[56] References Cited

U.S. PATENT DOCUMENTS

| | | | |
|---|---|---|---|
| 2,935,543 | 5/1960 | Smith | 585/738 |
| 2,958,644 | 11/1960 | Kimberlin et al. | 208/64 |
| 3,069,362 | 12/1962 | Mays et al. | 585/829 |
| 3,078,645 | 2/1963 | Milton | 585/820 |
| 3,227,647 | 1/1966 | Krane | 585/738 |
| 3,700,589 | 10/1972 | Symoniak et al. | 585/826 |
| 3,756,940 | 9/1973 | Donaldson | 208/65 |
| 3,770,621 | 11/1973 | Collins et al. | 585/826 |
| 3,785,955 | 1/1974 | Davis | 208/64 |
| 4,210,771 | 7/1980 | Holcombe | 585/738 |

*Primary Examiner*—Curtis R. Davis

*Attorney, Agent, or Firm*—Llewellyn A. Proctor

[57] ABSTRACT

A reformate lean oil absorber is used in the downstream processing facilities of a reformer unit to remove isobutane and heavier components from a separator overhead vapor, part of which is reformer recycle gas. Stabilized reformate may be employed as lean oil to the absorber, and the fat oil is recycled to the stabilizer for isobutane recovery of isobutane and normal butane as overhead product and $C_5$+ liquid as bottoms product. The mixed butanes are separated, and the isobutane employed as alkylation feedstock. The n-butane is recycled with the naphtha to the reformer unit, the absence of butanes in the recycle gas considerably enhancing the amount of isobutane produced in the reforming unit.

4 Claims, 2 Drawing Figures

REFORMING AND ISOMERIZATION PROCESS

BACKGROUND OF THE INVENTION AND PRIOR ART

Figure 1:
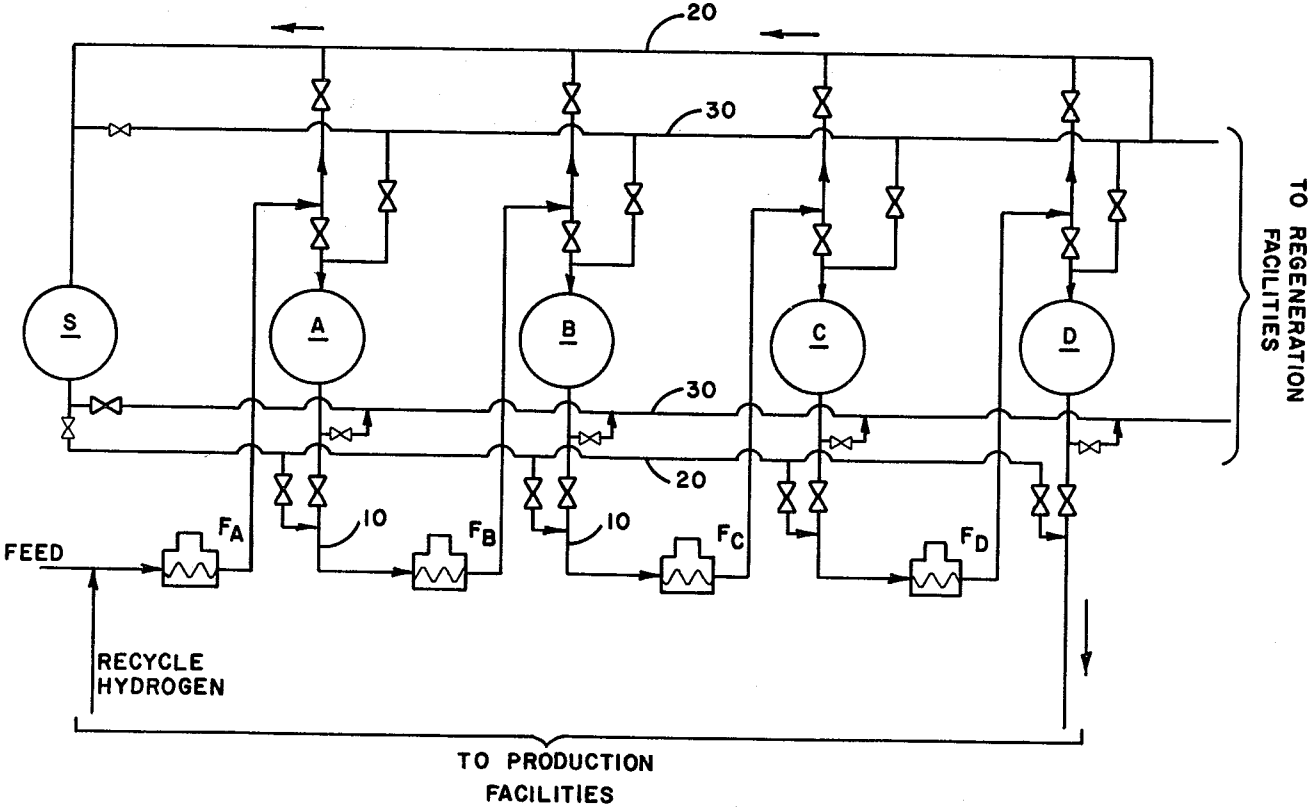

Alkylation is the introduction of an alkyl group into a molecule. An alkylation process is commonly used in refinery operations for the production of highly branched $C_7+$ to $C_9+$ paraffins, e.g., the production of high octane isooctane from isobutane and isobutene. Paraffin alkylation can be conducted thermally or catalytically. Typically, the catalytic alkylation of isoparaffins with olefins is conducted in the presence of a sulfuric acid or hydrogen fluoride catalyst. In such processes the gaseous reactants are fixed as liquid products suitable for incorporation within motor fuels to boost the octane.

Catalytic reforming (hydroforming) is a well established industrial process employed by the petroleum industry for improving the octane quality of naphthas or straight run gasolines. In reforming, a multi-functional catalyst is employed which contains a metal hydrogenation-dehydrogenation (hydrogen transfer) component, or components, substantially atomically dispersed upon the surface of a porous, inorganic oxide support, notably alumina. Noble metal catalysts, notably platinum, or metal promoted platinum catalysts, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst.

Reforming reactions are both endothermic and exothermic, the former predominating, particularly in the early stages of reforming with the latter predominating in the latter stages of reforming. In view thereof, it has become the practice to employ a plurality of adiabatic fixed-bed reactors in series with provision for interstage heating of the feed to each of the several reactors. There are two major types of reforming. In semi-regenerative reforming, the entire unit is operated by gradually and progressively increasing the temperature to compensate for deactivation of the catalyst caused by the coke deposition, until finally the entire unit is shut down for regeneration, and reactivation, of the catalyst. In cyclic reforming, the reactors are individually isolated, or in effect swung out of line by various piping arrangements, the catalyst is regenerated to remove the coke deposits, and then reactivated while the other reactors of the series remain on stream. A "swing reactor" temporarily replaces a reactor which is removed from the series for regeneration and reactivation of the catalyst, and is then put back in series. In either type of reforming, hydrogen is produced in net yield, the product being separated into a $C_5+$ liquid product, e.g., a 160° F./430° F. or $C_5+$/430° F. product, and a hydrogen rich gas a portion of which is recycled to the several reactors of the process unit.

In this country, most high octane gasoline is produced from alkylation and catalytic cracking. Reforming, at least in a relative sense, is used to a somewhat lesser extent to produce high octane gasoline. In some other parts of the world, there is often low cracking and alkylation capacity and large reforming capacity. Reforming is often practiced abroad more widely than any other operation except, of course, crude distillation. In any regard, internally there is often excess reforming capacity. Moreover, there is often a need for the production of isobutane, a useful alkylate feed.

Reformer feeds do not normally contain any butane, either n-butane or isobutane (the desirable isomer for alkylation purposes), although both are produced during reforming, and found in the reformate. The ratio of the n-butane and isobutane found in the reformate, however, is limited by equilibrium conditions. Whereas some of the n-butane produced in the reformate can be recycled, or n-butane added to the reformer feed to increase isobutane production, the production of isobutane by this method is severely inhibited due to the presence of substantial concentrations of isobutane in the recycle gas.

Nonetheless, it is the prime objective of this invention to provide a new and improved process for the simultaneous conversion of n-butane, including added amounts of n-butane, to isobutane, and the recovery of isobutane from a reforming unit.

In particular, it is an object to provide a new and improved reforming process for the increased isomerization of butane to produce isobutane, and the coproduction of isobutane and a $C_5+$ liquid reformate.

These objects and others are achieved in accordance with the present invention which comprises a new and improved mode of operating a reforming unit to coproduce isobutane, and an essentially $C_5+$ liquid product. A naphtha feed which contains n-butane, or naphtha and n-butane as separate streams, is fed into the land reactor of a multiple reactor reformer unit, with hydrogen, and reacted at reforming conditions over a reforming catalyst, in generally conventional manner. Suitably, however, from about 2 percent to about 30 percent, preferably from about 5 percent to about 20 percent, of the feed to the reformer is constituted of n-butane, based on the total volume of feed to the reforming unit. The product from the reforming unit contains n-butane and isobutane in admixture, $C_5+$ liquid, and lighter hydrocarbons, inclusive of hydrogen. The reformate from the last reactor of the series is cooled and separated into vapor and liquid, the vapor fraction is passed into an absorber, the liquid fraction is passed to a stabilizer, and a portion of the stabilized reformate from the stabilizer is countercurrently contacted within the absorber as a lean oil with said vapor fraction to strip primarily isobutane and heavier components from the vapor. The isobutane-denuded vapor fraction is separated into two portions, a first portion which is sent to other refining units, and a second portion which is recycled to the reforming unit as feed. The isobutane-containing fat oil from the absorber is sent to the stabilizer from which can be taken an isobutane rich stream and a conventional $C_5+$ liquid reformate as separate products. The isobutane rich stream can be subsequently processed to recover isobutane for use as alkylation feedback.

In accordance with this process, an absorber is included in the downstream processing facilities. An admixture of isobutane and heavier components from the reforming unit are separated in the absorber via countercurrent extraction with a portion of the stabilized reformate. Both isobutane and n-butane are recovered from the stabilizer overhead product, the isomers separated, and the isobutane recovered. Isobutane is then sent to an alkylation unit, and all or a part of the n-butane is recycled to the reforming unit for conversion into an equilibrium admixture of n-butane and isobutane. Absorption of the separator overhead may also be carried out using any other type of lean oil such as extraneous heavy naphtha in the subsequent butane recovery. Thus, n-butane, which can be added with the naphtha feed, is in net-effect isomerized to isobutane providing an isobutane rich stream from which isobutane can be recovered for use as an alkylated feed. In addition, energy credits in the form of a higher purity, lower molecular weight recycle gas are provided. Moreover, placing the absorber upstream of the recycle gas compressor provides furnace fuel savings, and reduced compressor horsepower requirements. The higher purity recycle gas permits a lower recycle rate.

These features and others will be better understood by reference to the following more detailed description of the invention, and to the drawings to which reference is made.

In the drawings:

FIG. 1 depicts, by means of a simplified flow diagram, a preferred cyclic reforming unit inclusive of multiple on stream reactors, and an alternate or swing reactor inclusive of manifolds for use with catalyst regeneration and reactivation equipment (not shown).

Figure 2:
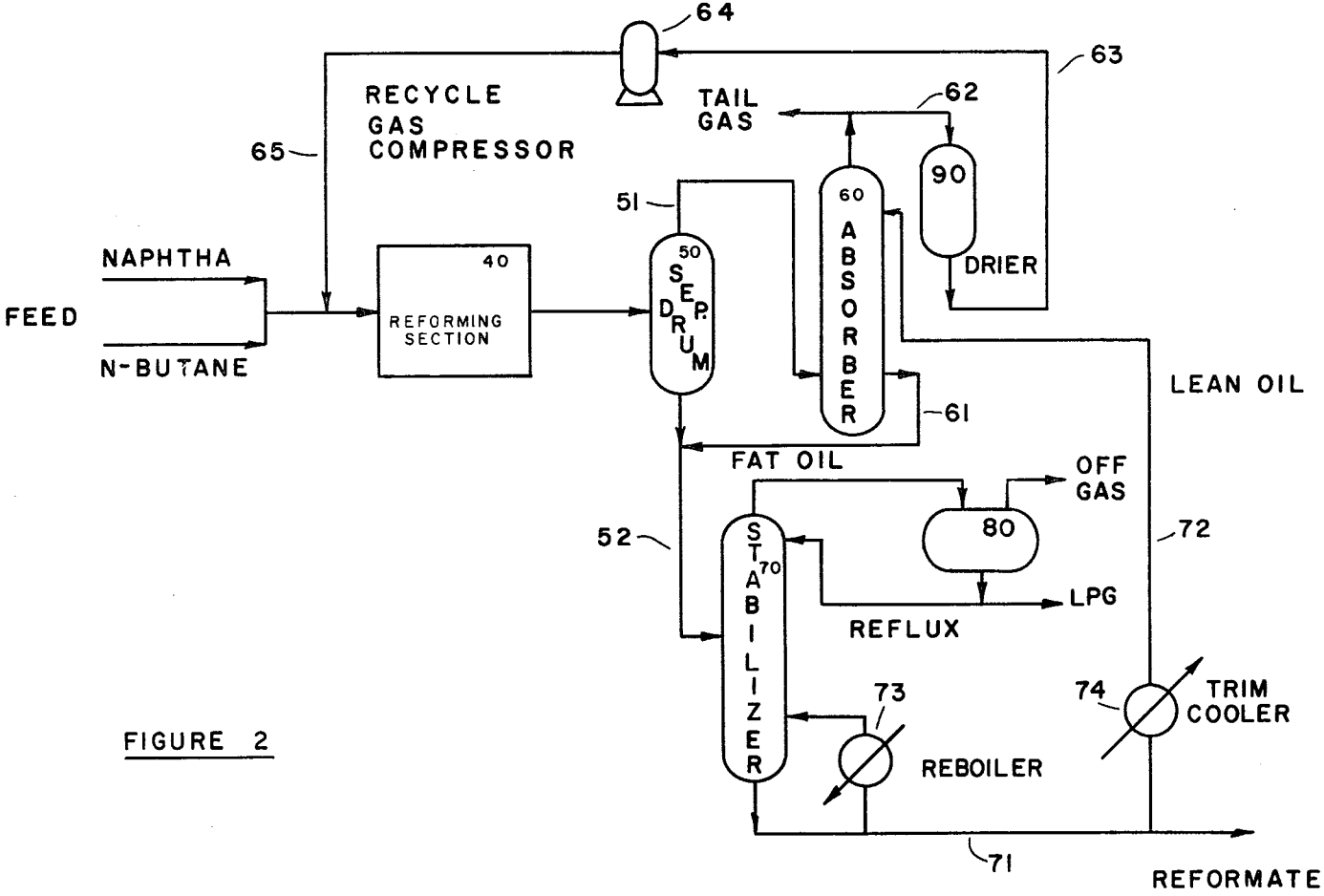

FIG. 2 further depicts the cyclic reforming unit of the preceding figure as a block labelled "Reforming Section," and the downstream production facilities required for the practice of this invention.

Referring to FIG. 1, generally, there is described a cyclic unit comprised of a multi-reactor system, inclusive of on stream reactors A, B, C, D and a swing reactor S, and a manifold useful with a facility for periodic regeneration and reactivation of the catalyst of any given reactor, swing reactor S being manifolded to reactors A, B, C, D so that it can serve as a substitute reactor for purposes of regeneration and reactivation of the catalyst of a reactor taken off stream. The several reactors of the series A, B, C, D, are arranged so that while one is off stream for regeneration and reactivation of the catalyst, the swing reactor S can replace it; and provision is also made for regeneration and reactivation of the swing reactor.

In particular, the on stream reactors A, B, C, D, each of which is provided with a separate furnace or heater $F_A$, or reheater $F_B$, $F_C$, $F_D$, respectively, are connected in series via an arrangement of connecting piping and valves so that feed can be passed in seratim through $F_A$A, $F_B$B, $F_C$C, $F_D$D, respectively; or generally similar grouping wherein any of reactors A, B, C, D are replaced by reactor S. This arrangement of piping and valves is designated by the numeral 10. Any one of the on stream reactors A, B, C, D, respectively, can be substituted by swing reactor S as when any one of the former requires regeneration and reactivation of the catalyst. This is accomplished in "paralleling" the swing reactor with the reactor to be removed from the circuit for regeneration by opening the valves on each side of a given reactor which connect to the upper and lower lines of swing header 20, and then closing off the valves in line 10 on both sides of said reactor so that fluid enters and exits from said swing reacotr S. Regeneration facilities, not shown, are manifolded to each of the several reactors A, B, C, D, S through a parallel circuit of connecting piping and valves which form the upper and lower lines of regeneration header 30, and any one of the several reactors can be individually isolated from the other reactors of the unit and the catalyst thereof regenerated and reactivated.

With reference to FIG. 2, the cyclic reforming unit of FIG. 1 is shown as a block diagram 40 labelled "Reforming section." A feed naphtha and recycle hydrogen, with additional n-butane are fed into the reforming section 40. The product from the reforming section 40, specifically from the last reactor of the series, is passed after cooling to about 100° F. into a separation drum 50 from wherein the light products are passed overhead via line 51 to absorber 60, and the higher boiling, or bottom products via line 52 to stabilizer 70. The overhead product from stabilizer 70 is fed into a horizontally oriented separation drum 80 from the overhead of which is taken an off-gas, and from the bottom of which is taken an isobutane rich light petroleum gas, LPG, after recycle of a portion of the light petroleum gas to the stabilizer 70 as reflux. The LPG gas contains n-butane which can be recovered, and recycled. Reformate is taken from the bottom of stabilizer 70 via line 71 as a liquid product, and a portion thereof is recycled via line 72 to the top of the absorber 60 as "lean oil." Heat is put into the stabilizer 70 via a reboiler 73, and the temperature of the lean oil recycle is adjusted via use of a heat exchanger, or trim cooler 74.

The lean oil, or stabilized reformate, introduced into the top of absorber 60 flow downwardly to absorb or strip isobutane and heavier, or higher boiling components from the light product gas stream from separator drum 50. The fat oil which is removed from the bottom of the absorber 60, and passed via lines 61,52 to the stabilizer 70, is thus an isobutane and n-butane enriched petroleum liquid. A portion of the overhead from the absorber 60 is recovered as tail gas and another portion is recycled via line 62 through a recycle gas drier 90. Gas from the recycle gas drier 90 is passed via line 63 to a recycle gas compressor 64, compressed, and recycled via line 65 to the reforming section 40.

The invention, and its principle of operation, will be more fully understood by reference to the following example.

EXAMPLE

Three cases illustrate the benefits of this invention. In case A, referring to the Table, a typical naphtha feedstock is reformed under normal condition to produce motor gasoline blendstock or feed to an aromatics recovery unit. In case, B, 10.4 vols. of n-butane area added to each 100 vols. of this same naphtha and the admixture is reformed in the reaction section after mixing with recycle gas. Case C employs the same n-butane/naphtha feed mixture as Case B, but isobutane and heavier components have been removed from the separator overhead vapor and, hence, the recycle gas is of composition compatable with the present invention.

TABLE

| | Case | | |
|---|---|---|---|
| | A | B | C |
| Description | Base Case Reforming Operation | Reforming With n-$C_4$ Addition | Reforming With n-$C_4$ Addition and Gas Absorber |
| Charge Stock | | | |
| Naphtha | | | |
| API Gravity | | 58.0 | |
| ASTM IBP/10% | | 158/209 | |

TABLE-continued

| Description | Case A Base Case Reforming Operation | Case B Reforming With n-$C_4$ Addition | Case C Reforming With n-$C_4$ Addition and Gas Absorber |
|---|---|---|---|
| ASTM 50%/90° F. | | 259/316 | |
| ASTM FBP | | 369 | |
| P/N/A[1], Vol. % | | 56/31/13 | |
| Butanes | | | |
| n-$C_4$, Vol/Vol Naphtha | 0 | 0.104 | 0.104 |
| i-$C_4$, Vol/Vol Naphtha | 0 | 0.006 | 0.006 |
| Operating Conditions | | | |
| Pressure, psig | | 200 | |
| Reactor Temperature, °F. | | 930 | |
| $H_2$/HC Ratio | 3.2 | 3.1 | 3.1 |
| Space Velocity, W/H/W | | 1.0 | |
| % Butanes i-$C_4$ + n-$C_4$ in Recycle Gas | 3.2 | 6.2 | <0.5 |
| Product Quality and Yields | | | |
| $C_5$+ Clear Res Octane | | 99.7 | |
| $C_5$+ Yield Vol/Vol Naphtha | 0.758 | 0.747 | 0.744 |
| n-$C_4$, Vol/Vol Naphtha | 0.051 | 0.128 | 0.106 |
| i-$C_4$, Vol/Vol Naphtha | 0.042 | 0.059 | 0.080 |
| Incremental $C_4$, Vol/Vol Added n-$C_4$ | — | 0.11 | 0.31 |

[1]Note:
Paraffins/naphthenes/aromatics.

The Table shows the added isobutane yield achieved in case C. As can be seen from the table, in Case A, 0.042 volumes of isobutane are obtained. If the charge stock is modified by the addition 0.104 vol. of n-$C_4$ per volume of naphtha, as shown in Case B, the yield of isobutane is increased somewhat from 0.042 to 0.059 vols. per vol. of naphta. A much more significant improvement in isobutane yield, however, is obtained in Case C, where all butanes are extracted from the recycle gas in an absorber. The recycle gas entering the reactor does not contain any butanes, thus avoiding the inhibiting effect of the recycled isobutane on the isomerization reaction of the n-butane added with the feed. This added butane can produce an equilibrium of isobutane and n-butane mixture. Hence, Case C shows 90% greater isobutane yield than the base Case A and 36% greater isobutane yield than Case B. When butanes are removed from the recycle gas, the incremental isobutane yield, based on n-butane added with the feed, thus shows about a three-fold increase, i.e., from 0.11 to 0.31 vol./vol. of added n-butane.

Catalysts suitable for the practice of this invention are constituted of a Group VIII noble metal, or platinum group metal, particularly platinum, alone or in admixture with other metal components. These components can also be present in admixture with one or more additional platinum group or non-platinum group metallic components such as germanium, gallium, tin, iridium, rhenium, tungsten, and the like. A preferred type of catalyst contains the hydrogenation-dehydrogenation component in absolute concentration ranging from about 0.01 to about 3 wt. %, and preferably from about 0.3 to about 1.0 wt. %, based on the total catalyst composition. A metal promoter component can also be added in absolute concentrations ranging from about 0.01 to about 3 wt. %, preferably from about 0.2 to about 1.0 wt. %. In addition, such catalysts also usually contain an acid component, preferably halogen, particularly chlorine or fluorine, in concentration ranging from about 0.1 to about 3 wt. %, and preferably from about 0.3 to about 1.5 wt. %. The hydrogenation-dehydrogenation components are composited with an inorganic oxide support, such as silica, silica-alumina, magnesia, thoria, zirconia, or the like, and preferably alumina.

Platinum catalysts are preferred. The catalyst is constituted of composite particles which contain, besides a carrier or support material, a hydrogenation-dehydrogenation component, or components, and a halide component. The support material is constituted of a porous, refractory inorganic oxide, particularly alumina. The support can contain, e.g., one or more of alumina, bentonite, clay, diatomaceous earth, zeolite, silica, activated carbon, magnesia, zirconia, thoria, and the like; through the most preferred support is alumina to which, if desired, can be added a suitable amount of other refractory carrier materials such as silica, zirconia, magnesia, titania, etc., usually in a range of about 1 to 20 percent, based on the weight of the support. A preferred support for the practice of the present invention is one having a surface area of more than 50 $m^2/g$, preferably from about 100 to about 300 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30° to 300°A.

The metal hydrogenation-dehydrogenation component can be composited with or otherwise intimately associated with the porous inorganic oxide support or carrier by various techniques known to the art such as ion-exchange, coprecipitation with the alumina in the sol or gel form, and the like. For example, the catalyst composite can be formed by adding together suitable reagents such as a salt of platinum and a salt of a promoter metal, or metals, and ammonium hydroxide or carbonate, and a salt of aluminum such as aluminum chloride or aluminum sulfate to form aluminum hydroxide. The aluminum hydroxide containing the salts of platinum and the promoter metal, or metals, can then be heated, dried, formed into pellets or extruded, and then calcined in nitrogen or other non-agglomerating atmosphere. The metal hydrogenation components can also be added to the catalyst by impregnation, typically via an "incipient wetness" technique which requires a minimum of solution so that the total solution is absorbed, initially or after some evaporation.

It is preferred to deposit the platinum, platinum and other metals used as promoters, if any, on a previously pilled, pelleted, beaded, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic components.

To enhance catalyst performance in reforming operations, it is also required to add a halogen component to the catalysts, fluorine and chlorine being preferred halogen components. The halogen is contained on the catalyst within the range of 0.1 to 3 percent, preferably within the range of about 0.3 to about 1.5 percent, based on the weight of the catalyst. When using chlorine as a halogen component, it is added to the catalyst within the range of about 0.2 to 2 percent, preferably within the range of about 0.5 to 1.5 percent, based on the weight of the catalyst. The introduction of halogen into the catalyst can be carried out by any method at any time. It can be added to the catalyst during catalyst preparation, for example, prior to, following or simultaneously with the incorporation of the metal hydrogenation-dehydrogenation component, or components. It can also be introduced by contacting a carrier material in a vapor phase or liquid phase with a halogen compound such as hydrogen fluoride, hydrogen chloride, ammonium chloride, or the like.

The catalyst is dried by heating at a temperature above about 80° F., preferably between about 150° F. and 300° F., in the presence of nitrogen or oxygen, or both, in an air stream or under vacuum. The catalyst is calcined at a temperature between about 500° F. to 1200° F., preferably about 500° F. to 1000° F., either in the presence of oxygen in an air stream or in the presence of an inert gas such as nitrogen.

The feed or charge stock can be a conventional naphtha boiling between about 120° F. and about 430° F., preferably between about 150° F. and about 400° F., which has been suitably pretreated to eliminate catalyst contaminants such as sulfur and nitrogen compounds, moisture, etc. The feed can contain from about 30 percent to about 80 percent, preferably from about 40 percent to about 70 percent, of paraffins, based on the volume of the total feed. Butane added to the feed or charge stock should be largely the n-isomer, and should preferably contain less than about 10 percent isobutane, by volume. The proportion of the naphtha and butane fractions constituting the feed or charge stock may vary from a naphtha:butane parts ratio of from about 100:2 to about 100:25, preferably from about 100:5 to about 100:15, by volume. The added butane must likewise be free of contaminants, i.e., sulfur, nitrogen, moisture, etc.

The reforming runs are initiated by adjusting the hydrogen and feed rates, and the temperature and pressure to operating conditions. The run is continued at optimum reforming conditions by adjustment of the major process variables, within the ranges described below:

| Major Operating Variables | Typical Process Conditions | Preferred Process Conditions |
|---|---|---|
| Pressure, Psig | 50–750 | 100–400 |
| Reactor Temp., °F. | 800–1200 | 800–1000 |
| Recycle Gas Rate, SCF/B | 1000–10,000 | 1500–4000 |
| Feed Rate, W/Hr/W | 0.5–10 | 1.0–5 |

It is apparent that various modifications and changes can be made without departing from the spirit and scope of the present invention.

Having described the invention, what is claimed is:

1. In a process for reforming, with hydrogen, a naphtha feed in a reforming unit which contains a plurality of on stream reactors connected in series, the hydrogen and naphtha flowing from one reactor of the series to another to contact the catalyst contained therein at reforming conditions, a reformate is taken from the final reactor of the series passed into a separator and separated into gaseous and liquid components, at least a portion of the gas is recycled to the reforming unit and the liquid is passed into a stabilizer for recovery of light petroleum gases and a $C_5+$ liquid product, the improvement comprising including within the reforming unit an absorber, passing the gaseous component, which contains n-butane and isobutane in admixture, from the separator into the absorber and countercurrently contacting said gas with a portion of the stabilized liquid from the stabilizer as lean oil, removing the stabilized liquid from the absorber as an isobutane and heavier enriched fat oil and passing same to the stabilizer, recycling the butanes denuded gas from the absorber to the reforming unit, adding n-butane to the reforming unit for conversion to isobutane, and recovering from the stabilizer a $C_5+$ liquid reformate, and a stream of liquidified petroleum gases from which n-butane and isobutane can be readily recovered.

2. The process of claim 1 wherein n-butane is added with naphtha as feed by recycle to the reforming unit.

3. The process of claim 2 wherein from about 2 percent to about 30 percent of the total volume of the feed to the reforming unit is n-butane.

4. The process of claim 3 wherein from about 5 percent to about 20 percent of the feed is n-butane.

* * * * *